US010023410B2

(12) United States Patent
Hashimoto et al.

(10) Patent No.: US 10,023,410 B2
(45) Date of Patent: Jul. 17, 2018

(54) SHEET CONVEYING APPARATUS

(71) Applicant: Brother Kogyo Kabushiki Kaisha, Nagoya-shi, Aichi-ken (JP)

(72) Inventors: Yohei Hashimoto, Nagakute (JP); Yuji Tokoro, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/472,423

(22) Filed: Mar. 29, 2017

(65) Prior Publication Data

US 2017/0283196 A1 Oct. 5, 2017

(30) Foreign Application Priority Data

Mar. 31, 2016 (JP) ..... 2016-071781

(51) Int. Cl.

| | |
|---|---|
| ***B65H 3/52*** | (2006.01) |
| ***B65H 3/68*** | (2006.01) |
| ***B65H 3/46*** | (2006.01) |
| ***B65H 1/04*** | (2006.01) |
| ***B65H 1/26*** | (2006.01) |
| ***B65H 3/06*** | (2006.01) |

(52) U.S. Cl.

CPC ..... *B65H 3/68* (2013.01); *B65H 1/04* (2013.01); *B65H 1/266* (2013.01); *B65H 3/06* (2013.01); *B65H 3/46* (2013.01); *B65H 2405/332* (2013.01)

(58) Field of Classification Search

CPC ... B65H 1/04; B65H 3/46; B65H 3/52; B65H 3/5207; B65H 3/5215; B65H 3/5246; B65H 3/5253; B65H 3/5261; B65H 3/66; B65H 3/68; B65H 2404/7431; B65H 2405/332; B65H 5/06; B65H 5/062

USPC ..... 271/264

See application file for complete search history.

(56) References Cited

U.S. PATENT DOCUMENTS 5,294,106 A * 3/1994 Takagi ..... B65H 1/04 271/162
7,775,516 B2 8/2010 Miwa
8,322,716 B2 12/2012 Miwa
(Continued)

FOREIGN PATENT DOCUMENTS

JP 2003-321144 A 11/2003
JP 2007-302380 A 11/2007
(Continued)

*Primary Examiner* — Prasad V Gokhale
(74) *Attorney, Agent, or Firm* — Banner & Witcoff, Ltd.

(57) ABSTRACT

A sheet conveying apparatus includes a first roller, a first guide, a second guide, a second roller, and a third roller. The first guide is configured to guide the sheet conveyed by the first roller and includes a first guide surface and a first edge portion located downstream of the first guide surface in a sheet conveying direction. The second guide, disposed downstream of the first guide, includes a second guide surface and a second edge portion located upstream of the second guide surface. The second roller is disposed downstream of the first roller and above the first roller. The third roller is disposed at a position more proximate to the second guide surface than the second roller. When projected on a cut plane orthogonal to an axis of the third roller, at least of a part of the second edge portion overlaps the third roller.

13 Claims, 14 Drawing Sheets

(56) References Cited

U.S. PATENT DOCUMENTS

| | | | | |
|---|---|---|---|---|
| 8,434,755 | B2 | 5/2013 | Imai | |
| 2004/0251602 | A1* | 12/2004 | Ruhe | B65H 1/04 271/167 |
| 2009/0001660 | A1* | 1/2009 | Miwa | B65H 1/26 271/226 |
| 2010/0303529 | A1* | 12/2010 | Shiba | B65H 5/062 399/388 |
| 2011/0115149 | A1 | 5/2011 | Imai | |
| 2011/0272876 | A1* | 11/2011 | Sugimoto | B65H 3/5261 271/10.13 |
| 2012/0051818 | A1* | 3/2012 | Yamaguchi | B65H 3/06 399/397 |
| 2014/0175739 | A1* | 6/2014 | Sunohara | B65H 43/02 271/258.01 |

FOREIGN PATENT DOCUMENTS

| | | | | | |
|---|---|---|---|---|---|
| JP | 2009-007123 | A | | 1/2009 | |
| JP | 2011-105416 | A | | 6/2011 | |
| JP | 2015-055648 | A | | 3/2015 | |
| JP | 2015059041 | A | * | 3/2015 | B65H 1/14 |

* cited by examiner

SHEET CONVEYING APPARATUS

CROSS-REFERENCE TO RELATED APPLICATION

This application claims priority from Japanese Patent Application No. 2016-071781 filed on Mar. 31, 2016, the content of which is incorporated herein by reference in its entirety.

FIELD OF DISCLOSURE

Aspects disclosed herein relate to a sheet conveying apparatus configured to convey a sheet.

BACKGROUND

A known sheet conveying apparatus includes a first guide and a second guide, which define a curved sheet conveyance path. The first guide is inclined relative to a sheet conveying direction to reduce unwanted noise due to a collision of a trailing end of a sheet with the first guide and the second guide.

SUMMARY

It may be beneficial to provide a sheet conveying apparatus including a first guide and a second guide which convey a sheet smoothly while reducing unwanted noise.

According to an aspect of the disclosure, a sheet conveying apparatus is configured to convey a sheet and includes a first roller, a first guide, a second guide, a second roller, and a third roller. The first roller is configured to convey a sheet in a sheet conveying direction while rotating in contact with the sheet. The first guide is configured to guide the sheet conveyed by the first roller in the sheet conveying direction. The first guide includes a first guide surface and a first edge portion located downstream of the first guide surface in the sheet conveying direction. The second guide is disposed downstream of the first guide in the sheet conveying direction and configured to guide the sheet guided by the first guide in the sheet conveying direction. The second guide includes a second guide surface and a second edge portion located upstream of the second guide surface. The second guide is spaced apart from the first guide by a gap defined between the first edge portion of the first guide and the second edge portion of the second guide. The second roller is disposed downstream of the first roller in the sheet conveying direction and above the first roller in a vertical direction. The second roller is configured to convey the sheet in the sheet conveying direction while rotating in contact with the sheet. The third roller faces the second roller and is disposed at a position more proximate to the second guide surface than the second roller. The second roller and the third roller are configured to convey the sheet by nipping the sheet therebetween. A first imaginary tangent plane, which is tangent to a first contact point at which the first roller contacts the sheet, intersects a second imaginary tangent plane, which is tangent to a second contact point at which the second roller contacts the third roller, and the first imaginary tangent plane is located below the second contact point. The first edge portion of the first guide is located toward the second roller relative to the second imaginary plane. When projected on a cut plane orthogonal to an axis of the third roller, at least of a part of the second edge portion overlaps the third roller.

According to another aspect of the disclosure, a sheet conveying apparatus is configured to convey a sheet and includes a first roller, a first guide, a second guide, a second roller, and a third roller. The first roller is configured to convey a sheet in a sheet conveying direction while rotating in contact with the sheet. A first guide is configured to guide the sheet conveyed by the first roller in the sheet conveying direction. The first guide includes a first guide surface and a first edge portion. The second guide is disposed downstream of the first guide in the sheet conveying direction and configured to guide the sheet guided by the first guide in the sheet conveying direction. The second guide includes a second guide surface and a second edge portion. The second guide is spaced apart from the first guide by a gap defined between the first edge portion of the first guide and the second edge portion of the second guide. The second roller is disposed downstream of the first roller in the sheet conveying direction and above the first roller in a vertical direction. The second roller is configured to convey the sheet in the sheet conveying direction while rotating in contact with the sheet. The third roller faces the second roller and is disposed at a position more proximate to the second guide surface than the second roller. The second roller and the third roller are configured to convey the sheet by nipping the sheet therebetween. A first imaginary tangent plane, which is tangent to a first contact point at which the first roller contacts the sheet, intersects a second imaginary tangent plane, which is tangent to a second contact point at which the second roller contacts the third roller, and the first imaginary tangent plane is located below the second contact point. The first edge portion of the first guide is located toward the second roller relative to the second imaginary tangent plane. The second edge portion includes a central portion in a width direction orthogonal to the sheet conveying direction and a thickness direction of the sheet. The central portion of the second edge portion is located toward the second roller relative to a third imaginary tangent plane including the first guide surface.

BRIEF DESCRIPTION OF THE DRAWINGS

Reference is made to the following description taken in connection with the accompanying drawings, like reference numerals being used for like corresponding parts in the various drawings.

DETAILED DESCRIPTION

Figure 1:
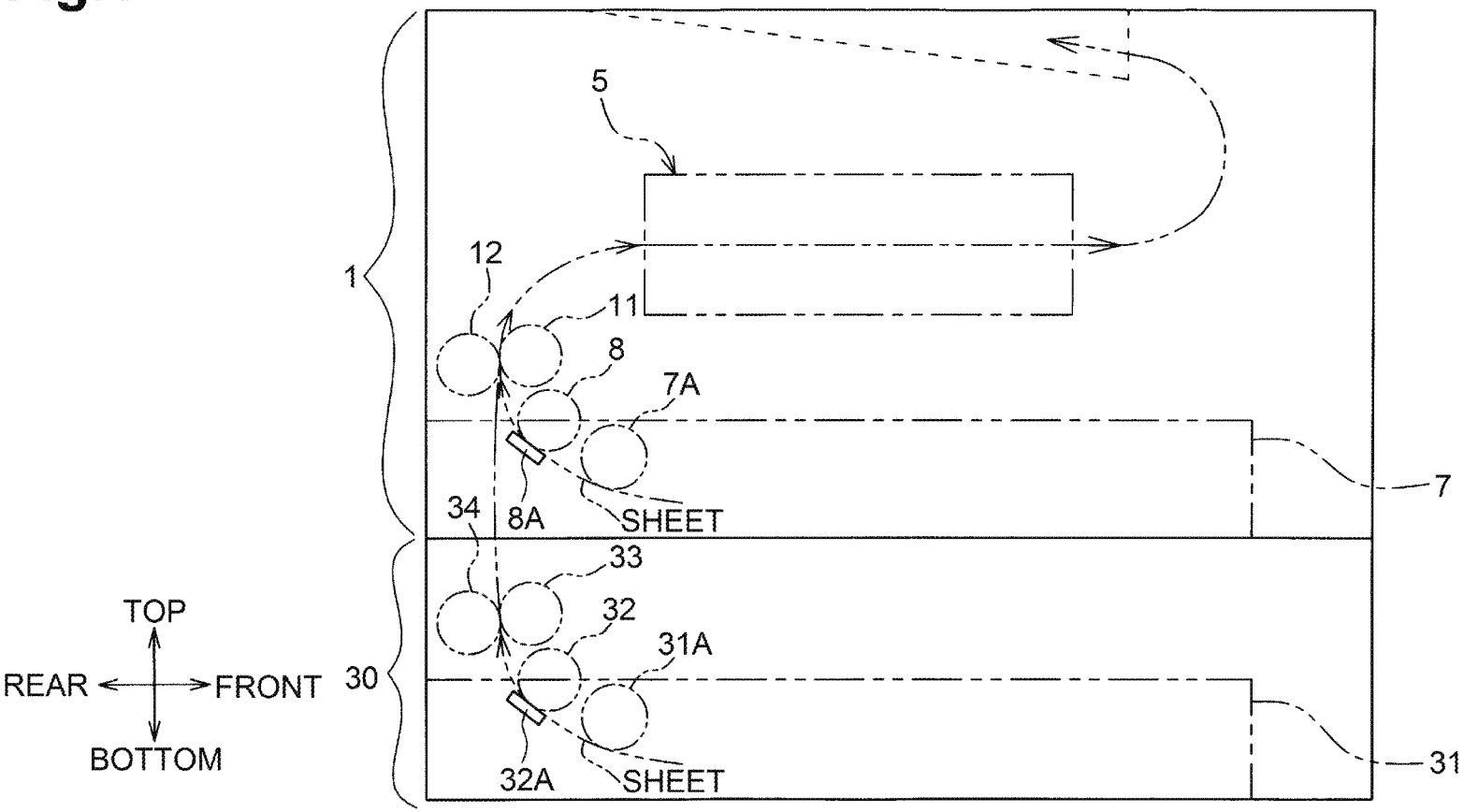
FIG. 1 schematically illustrates an image forming system according to an illustrative embodiment of the disclosure.

Illustrative embodiments described below are merely examples. Various changes, arrangements and modifications may be applied therein without departing from the spirit and scope of the disclosure.

Hereinafter, the illustrative embodiments of the disclosure will be described with reference to the accompanying drawings. Direction arrows indicated in the drawings may help easier understanding of relative relationship between the drawings. Therefore, the directions are not limited to the specific directions indicated in the drawings.

For portions or components, which will be described with numerals, at least one is provided unless "plural" or "two or more" is specifically stated otherwise.

An illustrative embodiment will be described.

The embodiment of the disclosure is applied to an image forming system including an electrophotographic image forming apparatus 1 and a sheet supply apparatus 30, which are illustrated in FIG. 1. The sheet supply apparatus 30 is optional and can be retrofitted to the image forming apparatus 1. The sheet supply apparatus 30 is detachably attached to the image forming apparatus 1.

General outline of the image forming system will be described.

As illustrated in FIG. 1, an image forming unit 5 is accommodated in the image forming apparatus 1. The image forming unit 5 is of an electrophotographic type and configured to form an image on a sheet by transferring a developer image on the sheet. The image forming apparatus 1 includes a sheet supply tray 7, which is detachably attached to a main body of the image forming apparatus 1.

The sheet supply tray 7 is configured to support one or more sheets thereon. A sheet supply roller 7A illustrated in FIG. 1 is configured to supply a sheet supported on the sheet supply tray 7 toward the image forming unit 5. A separation roller 8, a separation pad 8A, a feed roller 11, and a pinch roller 12 are disposed downstream of the sheet supply roller 7A in a sheet conveying direction.

The separation roller 8 is an example of a first roller configured to convey a sheet supplied by the sheet supply roller 7A while rotating in contact with the sheet. The separation roller 8 rotates upon receipt of a drive force, and thereby applies a conveying force to the sheet.

The separation pad 8A is disposed facing the separation roller 8. The separation pad 8A is configured to contact the sheet to apply a conveying resistance. Thus, if two or more sheets are supplied from the sheet supply roller 7A at a time, the sheets are separated one by one by the separation roller 8 and the separation pad 8A.

The feed roller 11 and the pinch roller 12 are disposed facing each other to nip the sheet conveyed by the separation roller 8 to feed the sheet. In other words, the feed roller 11 and the pinch roller 12 rotate in contact with the sheet to feed the sheet.

The feed roller 11 receives a drive force to rotate. The feed roller 11 is an example of a second roller. The pinch roller 12 presses the sheet against the feed roller 11 and is driven to rotate along with the sheet being fed. The pinch roller 12 is an example of a third roller.

The sheet supply apparatus 30 is disposed below the image forming apparatus 1. The sheet supply apparatus 30 is detachably attached to the image forming apparatus 1. The sheet supply apparatus 30 receives a drive force from the image forming apparatus 1 to supply a sheet to the image forming apparatus 1. The sheet supply apparatus 30 includes a sheet supply tray 31.

The sheet supply tray 31 is configured to support one or more sheets thereon. The sheet supply roller 31A is configured to supply a sheet supported on the sheet supply tray 31 toward the image forming unit 5. A separation roller 32, a separation pad 32A, a feed roller 33, and the pinch roller 34 are disposed downstream of the sheet supply roller 31A in the sheet conveying direction.

The separation roller 32, the feed roller 33 and the pinch roller 34 are identical in function to the separation roller 8, the feed roller 11, and the pinch roller 12, respectively. More specifically, the separation roller 32 and the separation pad 32A separate the sheets one by one and convey a single sheet toward the feed roller 33.

The feed roller 33 and the pinch roller 34 are disposed facing each other to nip the sheet conveyed by the separation roller 32 to feed the sheet toward the feed roller 11 of the image forming apparatus 1.

The following will describe the structure around the feed roller 11 in the image forming apparatus 1, which constitutes a sheet conveying apparatus of the disclosure.

Figure 4:
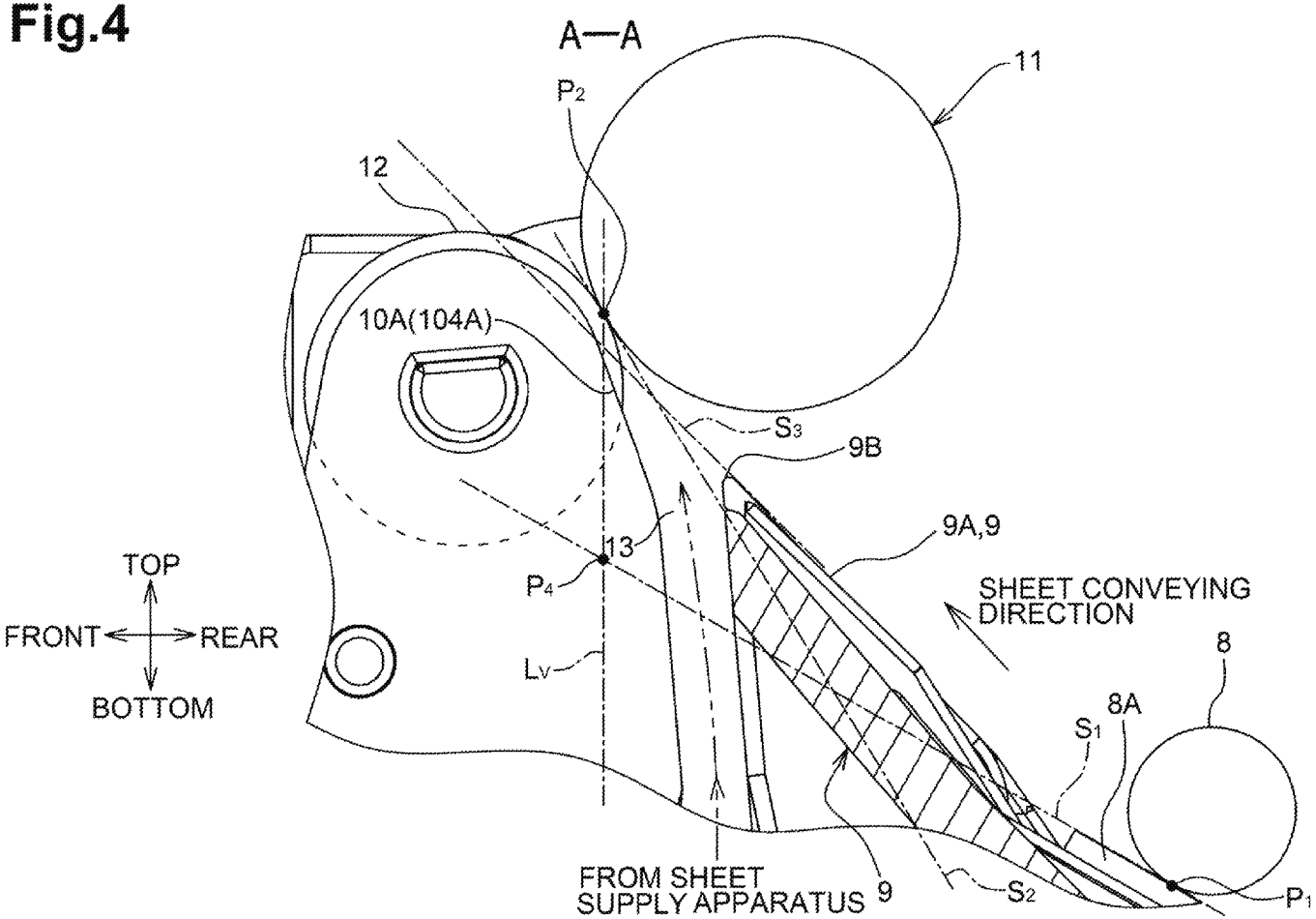
FIG. 4 is a cross-sectional view taken along line A-A in FIG. 3.

In the following description, the separation roller 8 is referred to as the first roller 8, the feed roller 11 is referred to as a second roller 11, and the pinch roller 12 is referred to as the third roller 12. As illustrated in FIG. 4, a first guide 9 is disposed downstream of the first roller 8 in the sheet conveying direction. The first guide 9 is configured to guide a sheet conveyed by the first roller 8 and includes a first guide surface 9A facing upward in the vertical direction.

Figure 2:
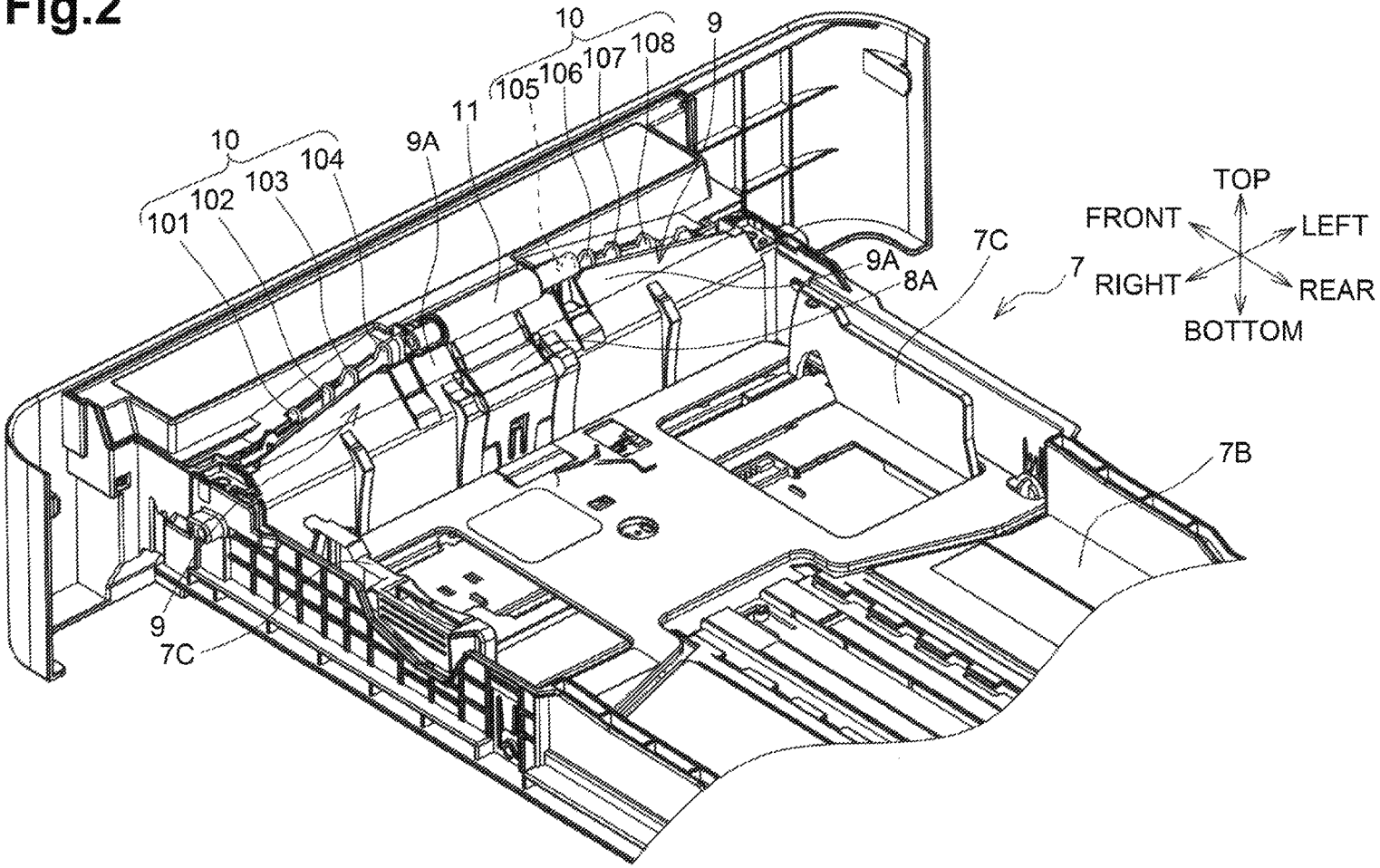
FIG. 2 is a partial perspective view of a sheet supply tray.
Figure 3:
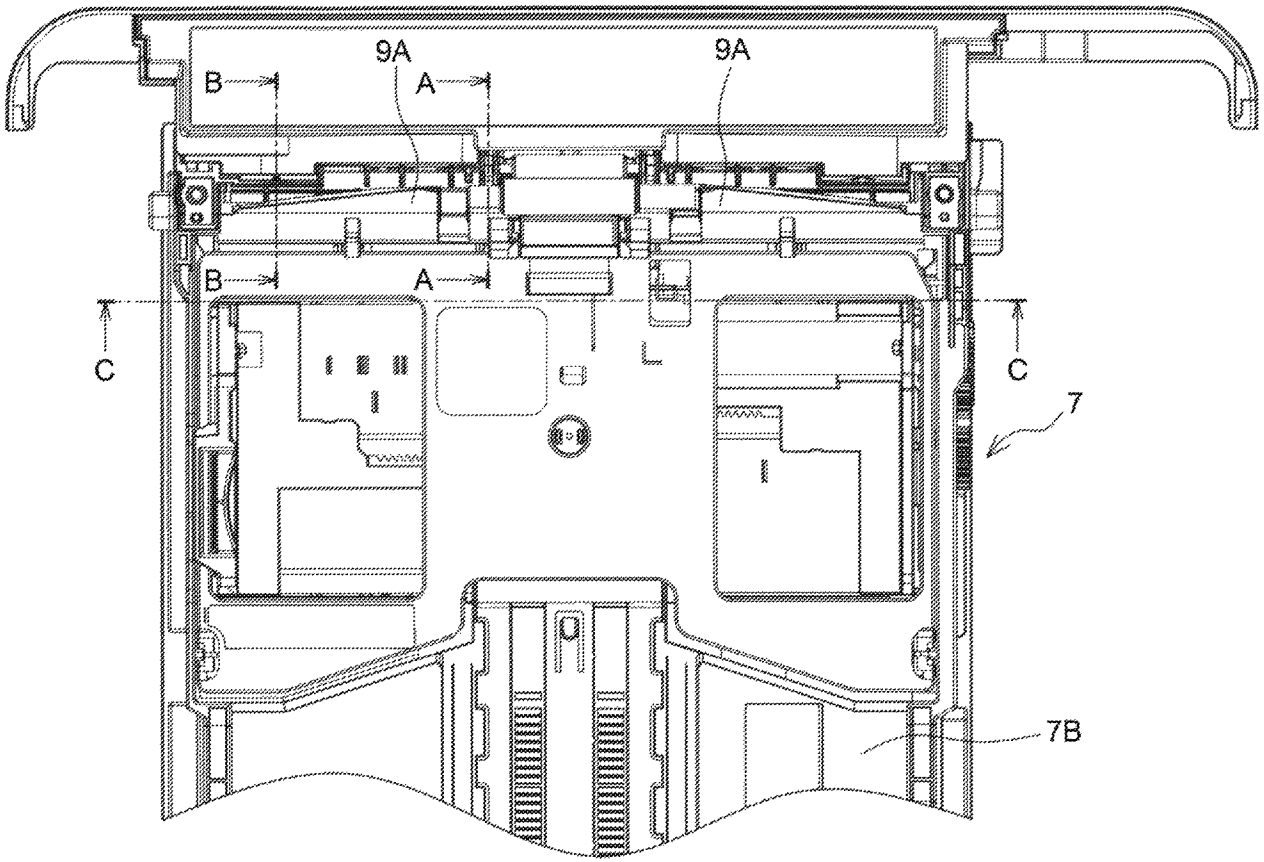
FIG. 3 is a top view of the sheet supply tray 7.

As illustrated in FIG. 2, the first guide surface 9A is inclined relative to a support surface 7B of the sheet supply tray 7. In the embodiment, the support surface 7B is a substantially horizontal surface, and the first guide surface 9A is an inclined surface which is inclined to the horizontal surface.

A second guide 10 is disposed downstream of the first guide 10 in the sheet conveying direction. The second guide 10 is configured to guide the sheet guided by the first guide 9.

Figure 6:
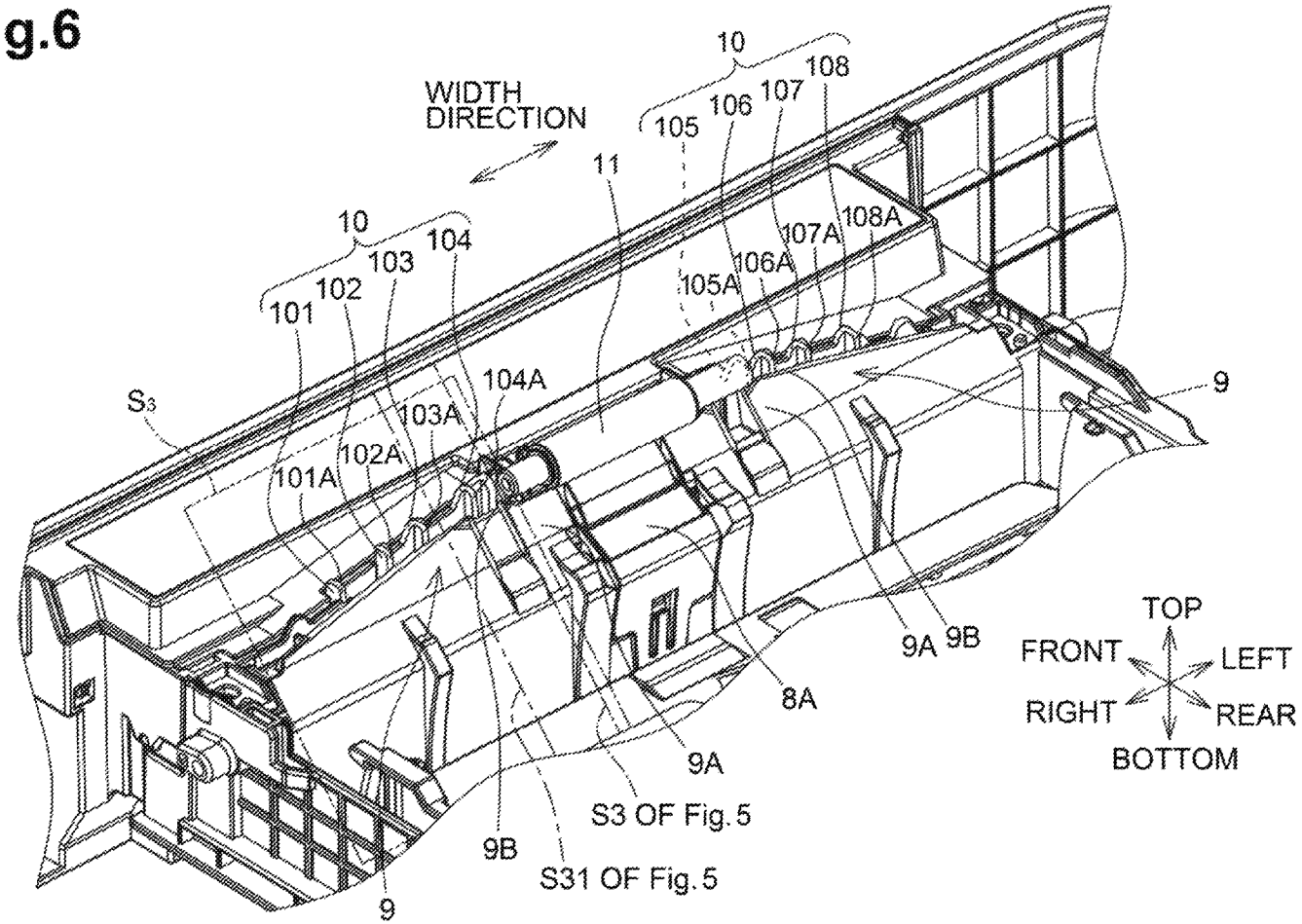
FIG. 6 is a partial perspective view of the sheet supply tray.
Figure 8:
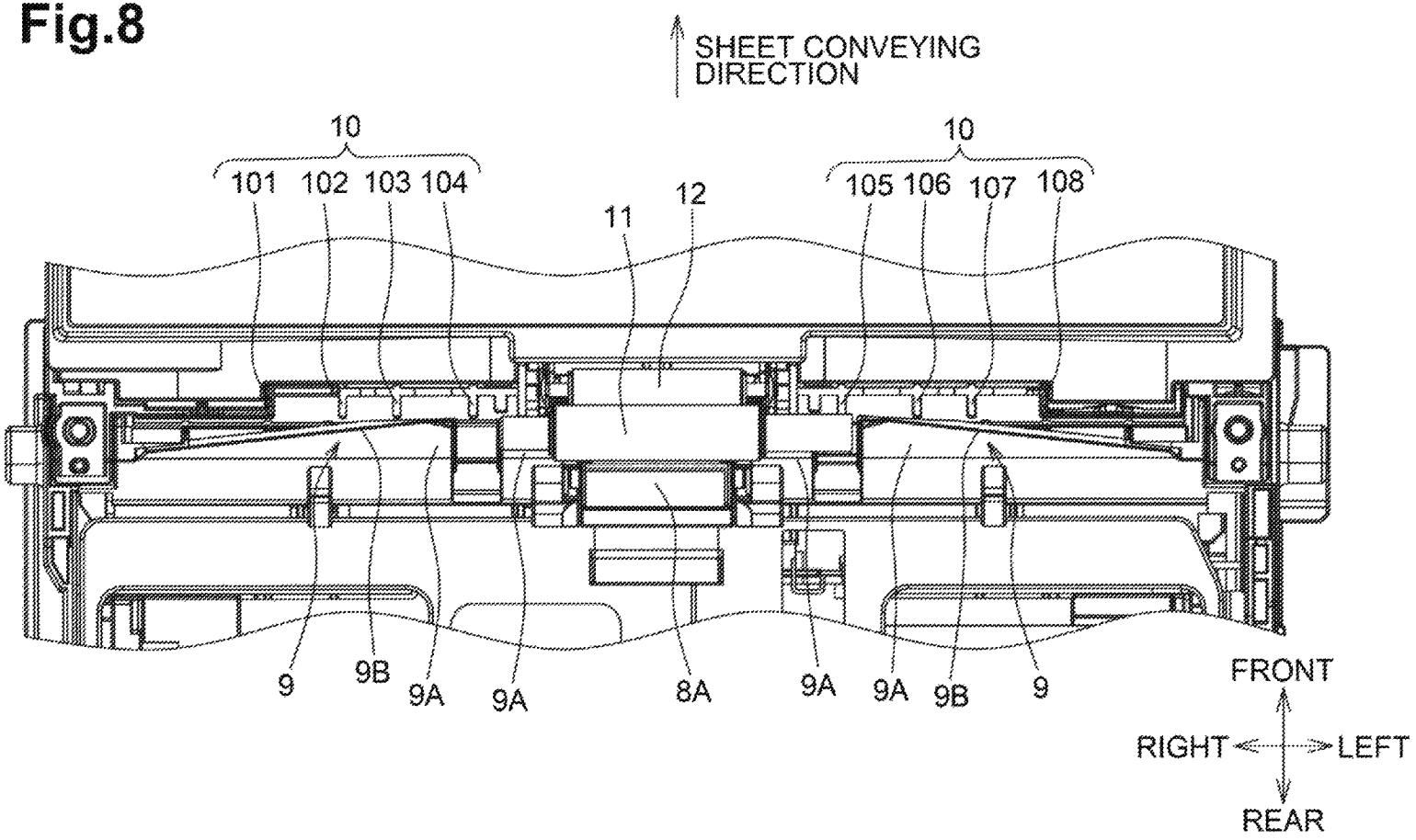
FIG. 8 is a partial top view of the sheet supply tray.

As illustrated in FIGS. 6 and 8, the second guide 10 includes a plurality of ribs 101-108. The ribs 101-108 extend in the vertical direction and are spaced apart from each other in a width direction orthogonal to the sheet conveying direction and a thickness direction of a sheet. In this embodiment, the width direction corresponds to a left-right direction of the sheet supply tray 7.

The ribs 101-108 that make up the second guide 10 have respective end surfaces 101A-108A. A sheet being conveyed contacts the end surfaces 101A-108A, which define a second guide surface 10A (FIG. 4) of the second guide 10.

As illustrated in FIG. 4, the second guide surface 10A is located toward the second roller 11 relative to a first imaginary tangent plane S1, which is a plane tangent to a first contact point P1 at which the first roller 8 contacts a sheet.

As illustrated in FIG. 4, the first imaginary tangent plane S1 coincides with an imaginary plane including a friction surface of the separation pad 8A. In other words, an imaginary plane tangent to the first contact point P1 between a sheet and the first roller 8 coincides with an imaginary plane tangent to a point of contact between the first roller 8 and the friction surface of the separation pad 8A. An imaginary plane tangent to a second contact point P2 at which the second roller 11 contacts the third roller 12 is referred to as a second imaginary tangent plane S2. The second contact point P2 is a nip point between the second roller 11 and the third roller 12.

The first imaginary tangent plane S1 intersects the second imaginary tangent plane S2. The first imaginary tangent plane S1 intersects a vertical line Lv passing through the second contact point P2 of the second imaginary tangent plane S2 at a point P4. As the point P4 is below the second contact point P2, the first imaginary tangent plane S1 is located below the second contact point P2. This means that a sheet conveyance path extending from the first contact point P1 toward the second contact point P2 has a curve whose center of curvature is located to the second roller 11 and the curve is convex toward the third roller 12.

Figure 5:
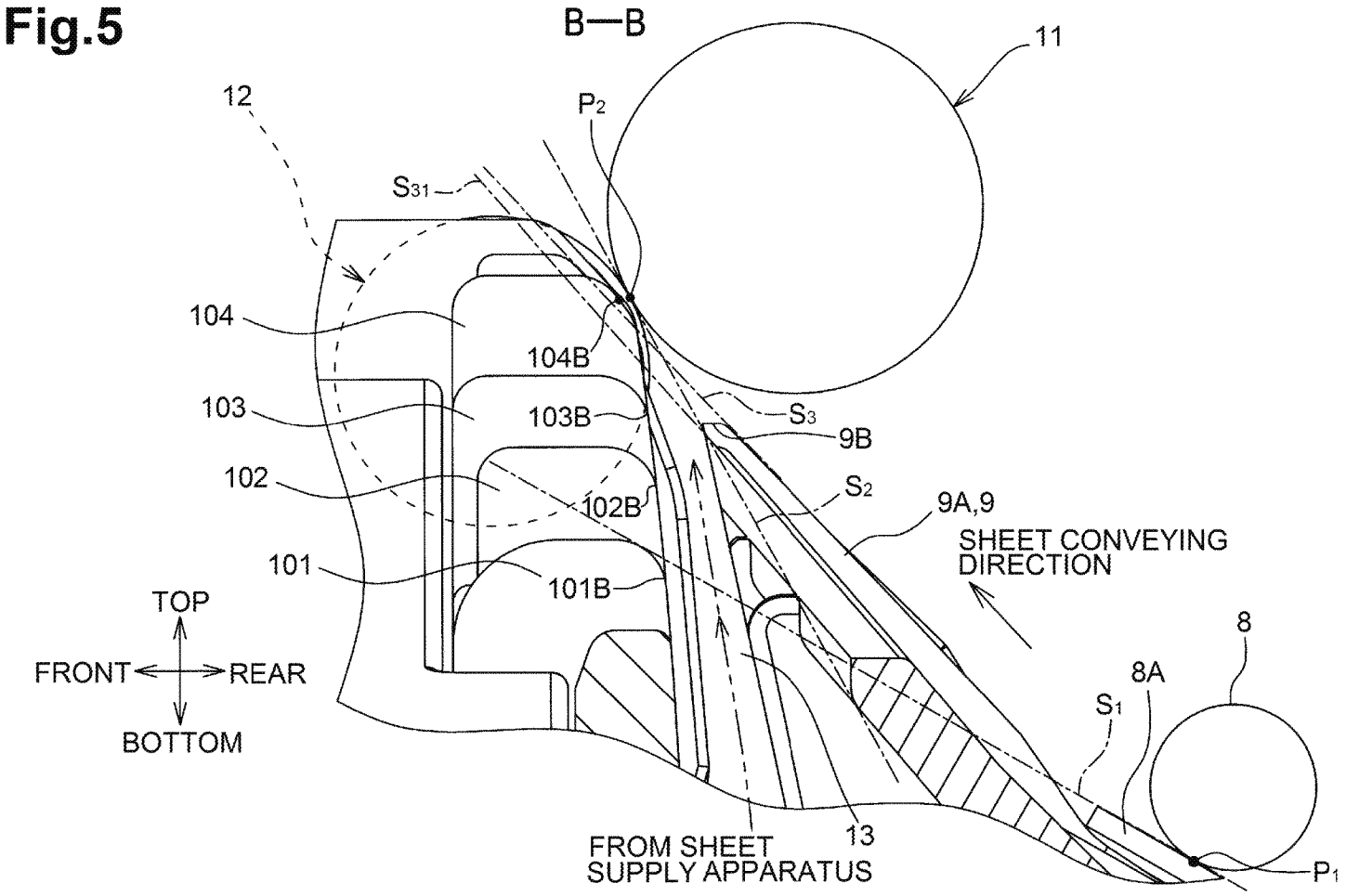
FIG. 5 is a cross-sectional view taken along line B-B in FIG. 3.

As illustrated in FIG. 5, the first guide 9 and the second guide 10 are spaced apart from each other by a gap 13, which forms a sheet conveyance path for conveying a sheet to be supplied from the sheet supply apparatus 30. The gap 13 is defined, for example, between a first edge portion 9B of the first guide 9 and each of second edge portions 101B-104B of the second guide 10.

The first edge portion 9B is an edge portion of the first guide 9 located downstream of the first guide surface 9A in the sheet conveying direction. The second edge portions 101B-104B are upstream edge portions of the end surfaces 101A-104A of the respective ribs 101-104 in the sheet conveying direction.

The ribs 105-108 are identical in structure to the ribs 101-104. Thus, the following will describe the structure of the second guide 10 using, as an example, the ribs 101-104, which are located to right of the second roller 11, as illustrated in FIG. 2. The rib 101 corresponds to the rib 108, the rib 102 corresponding to the rib 107, the rib 103 corresponding to the rib 106, the rib 104 corresponding to the rib 105.

As illustrated in FIGS. 5 and 6, the first guide 9 is inclined, the first guide surface 9A is thus an inclined surface, and the first edge portion 9B, which is a downstream edge portion of the first guide 9, extends in the width direction.

Figure 7:
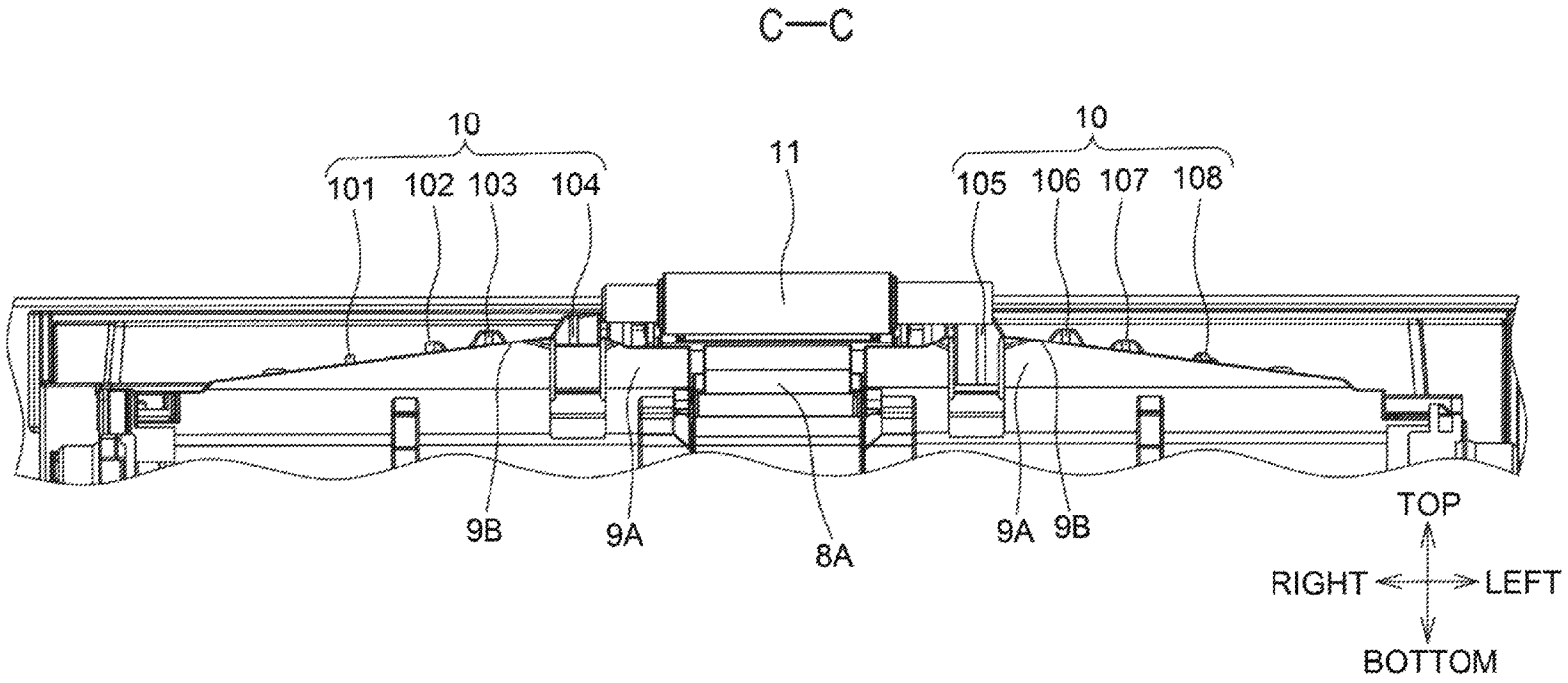
FIG. 7 is a cross-sectional view taken along line C-C in FIG. 3.

As illustrated in FIG. 7, the first edge portion 9B is inclined such that a central portion of the first edge portion 9B in the width direction, which is closer to the second roller 11, is higher than each end portion thereof, which is farther from the second roller 11.

As illustrated in FIG. 8, the first edge portion 9B is inclined such that each end portion of the first edge portion 9B is located upstream of the central portion of the first edge portion 9B in the sheet conveying direction.

A central portion of an object in the width direction corresponds to a middle of three substantially equal portions of the support surface 7B into which the width of the support surface 7B is divided. In this embodiment, the second roller 11 and the third roller 12 are disposed at substantially a central portion of the first guide 9 in the width direction, and the first edge portion 9B is substantially symmetrical relative to the central portion of the first guide 9 in the width direction.

As described above, the second guide 10 includes the ribs 101-108 which are spaced apart from each other in the width direction. The end surfaces 101A-108A of the respective ribs 101-108 define the second guide surface 10A of the second guide 10. The second edge portions 101B-104B of the respective end surfaces 101A-108A are closer to the first edge portion 9B than the remaining portions of the respective end surfaces 101A-108A. On each of the end surfaces 101-104A, a respective one of the second edge portions 101B-104B is closest to the first edge portion 9B. The second edge portion 101B, which is closest to the end of the second guide surface 10A in the width direction among the second edges portions 101B-104B, is located toward the third roller 12 relative to a third imaginary tangent plane S3, as illustrated in FIG. 5.

More specifically, the third imaginary tangent plane S3 includes the first guide surface 9A of the first guide 9. The second edge portion 101B, which is closest to the end of the second guide surface 10A in the width direction among the second edges portions 101B-104B, is located below the third imaginary tangent plane S3 in the vertical direction.

The second edge portion 102B and the second edge portion 103B are also located toward the third roller 12 relative to the third imaginary tangent plane S3, and located below the third imaginary tangent plane S3 in the vertical direction. The third imaginary tangent plane S3 according to the embodiment is a plane whose curvature is not zero or a plane having change in curvature.

In other words, the third imaginary tangent plane S3 has a portion, which corresponds to the central portion of the support surface 7B in the width direction, having positive and negative curvatures. The third imaginary tangent plane S3 is inclined relative to the width direction such that a portion of the third imaginary tangent plane S3 corresponding to each end portion of the support surface 7B in the width direction is closer to the first guide 9 than the portion of the third imaginary tangent plane S3 corresponding to the central portion of the support surface 7B in the width direction.

More specifically, the first guide surface 9A is not a simple flat surface or has some irregularities. The third imaginary tangent plane S3 illustrated in FIG. 5 is the third imaginary tangent plane S3 that intersects a vertical plane including the second edge portion 104B (refer to FIG. 6). An imaginary tangent surface S31 illustrated in FIG. 5 is the third imaginary tangent plane S3 that intersects a vertical plane including the second edge portion 103B (refer to FIG. 6).

In other words, the second edge portion 102B and the second edge portion 103B are located toward the third roller 12 relative to the third imaginary tangent plane S3 having change in curvature, and located below the third imaginary tangent plane S3 in the vertical direction.

The first edge portion 9B is located toward the second roller 11 relative to the second imaginary tangent plane S2. In other words, the first edge portion 9B according to the embodiment is located above a portion of the second imaginary tangent plane S2 in the vertical direction. When projected on a cut plane orthogonal to an axis of the third roller 12 or viewed in an axial direction of the third roller 12, the second edge portion 104B overlaps the third roller 12. The cut plane coincides with a cross-sectional view in FIG. 5.

The second edge portion 104B is located at the central portion of the second guide surface 10A in the width direction, and is located toward the second roller 11 relative to the third imaginary tangent plane S3. In other words, the second edge portion 104B is closest to an end of the third roller 12 in an axial direction thereof among the second edge portion 101B-104B, and is located above a portion of the third imaginary tangent plane S3 in the vertical direction. In this embodiment, the second edge portion 104B protrudes approximately 1 mm toward the second roller 11 relative to the third imaginary tangent plane S3.

A pair of side guides 7C (FIG. 2) is disposed on the support surface 7B to restrict positions of both ends of a sheet in the width direction. At least one of the side guides 7C is movable toward or away from the other one of the side guides 7C in the width direction to define a sheet width. Thus, a minimum distance between the side guides 7C defines a minimum width dimension for sheets to be conveyed in the sheet conveying apparatus. The central portion in the width direction has a dimension in the width direction, which is smaller than the minimum width dimension.

Figure 9:
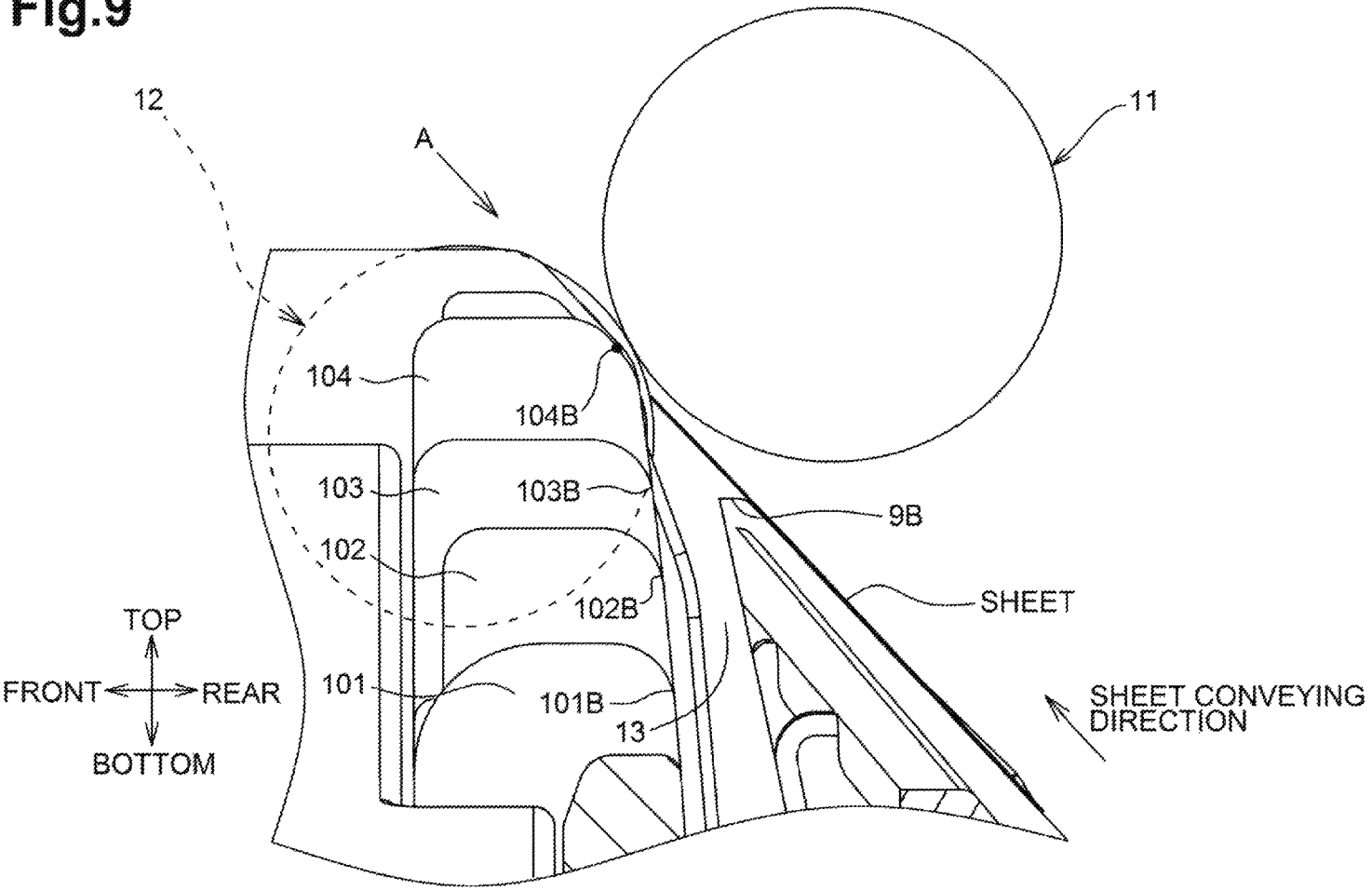
FIG. 9 is a cross-sectional view schematically illustrating that a leading end of a sheet contacts a third roller.
Figure 10:
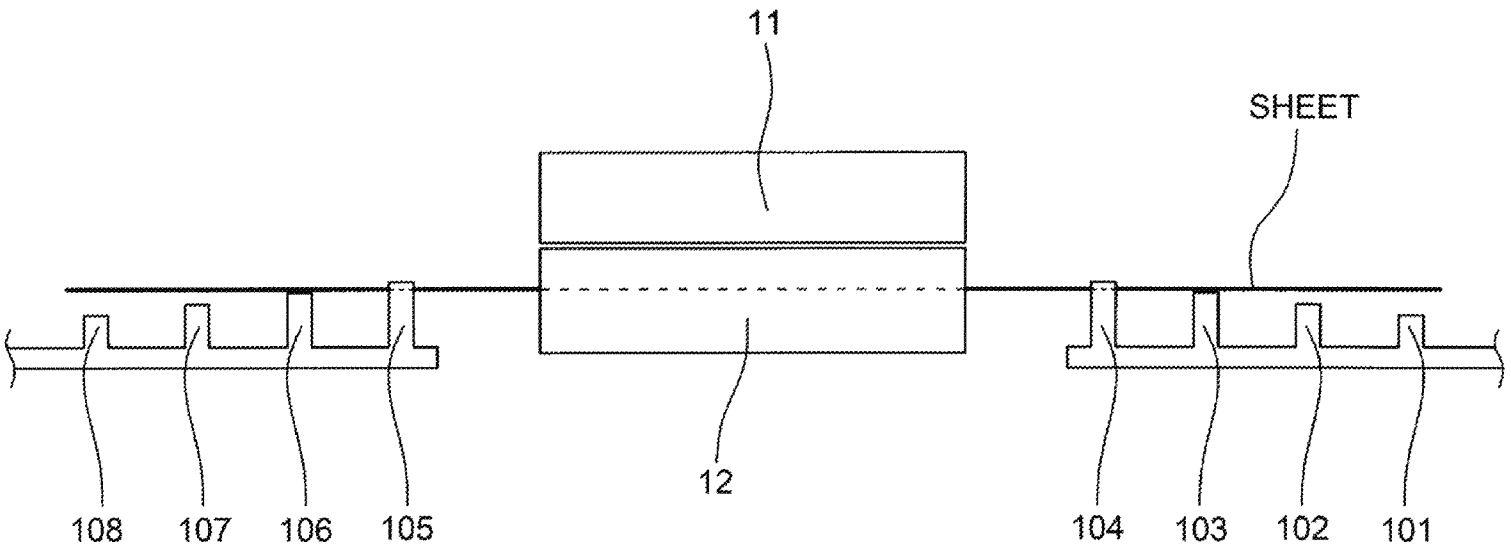
FIG. 10 is a view on arrow A in FIG. 9 illustrating that the leading end of the sheet contacts the third roller.

FIGS. 9 and 10 illustrate that the leading end of a sheet in the sheet conveying direction collides with the third roller 12.

In this embodiment, the second edge portions 101B, 102B, and 103B are closer in the width direction to the end of the second guide surface 10A than the second edge portion 104B, and are located toward the third roller 12 relative to the third imaginary tangent plane S3 (FIG. 5).

In other words, the second edge portions 101B, 102B, and 103B are recessed relative to a sheet to be guided on the first guide surface 9A. This reduces a possibility that the leading end of the sheet in the sheet conveying direction (hereinafter referred to just as the leading end of the sheet) collides with the second edge portions 101B, 102B, and 103B, and thus reduces the potential of a sheet jam.

The second edge portions 101B, 102B, 103B, and 104B are offset, in this order, toward the upstream side in the sheet conveying direction (or toward the right side in FIG. 9). Thus, the leading end of the sheet reaches the second edge portion 101B, the second edge portion 102B, the second edge portion 103B, and the second edge portion 104B in this order.

The second edge portion 104B is located at the central portion of the second guide surface 10A in the width direction and located toward the second roller 11 relative to the third imaginary tangent plane S3 including the first guide surface 9A (FIG. 5). In other words, the second edge portion 104B protrudes relative to the third imaginary tangent plane S3 including the first guide surface 9A on which a sheet is to be guided.

This rib may lead to a possibility that the leading end of a sheet being guided on the first guide surface 9A collides with the second edge portion 104B. However, the leading end of a sheet, which is separated from the first roller 8 and then conveyed along the third imaginary tangent plane S3, collides with the third roller 12, not the second edge portion 104B. This is because, when projected on the cut plane, the second edge portion 104B and the third roller 12 overlap (FIGS. 9 and 10).

After colliding with the third roller 12, the leading end of the sheet is smoothly guided to the nip point P2 by rotation of the third roller 12. This reduces the potential of sheet jam although the second edge portion 104B protrudes relative to the third imaginary tangent plane S3 (FIG. 5).

If the second edge portions 101B and 104B are located toward the second roller 11 relative to the third imaginary tangent plane S3, a sheet may warp in the width direction by a collision with the second edge portions 101B and 104B. At this time, the leading end of the sheet may be guided into the gap 13 by the third roller 12 rotating, and the sheet may be jammed at the gap 13.

In this embodiment, however, the second edge portion 101B, which is located at the end portion of the second guide surface 10A in the width direction and upstream of other second edge portions 102B, 103B, and 104B, is located toward the third roller 12 relative to the third imaginary tangent plane S3. This reduces a possibility that a corner at the leading end of a sheet is guided into the gap 13, and thus reduces the potential of sheet jam.

Figure 11:
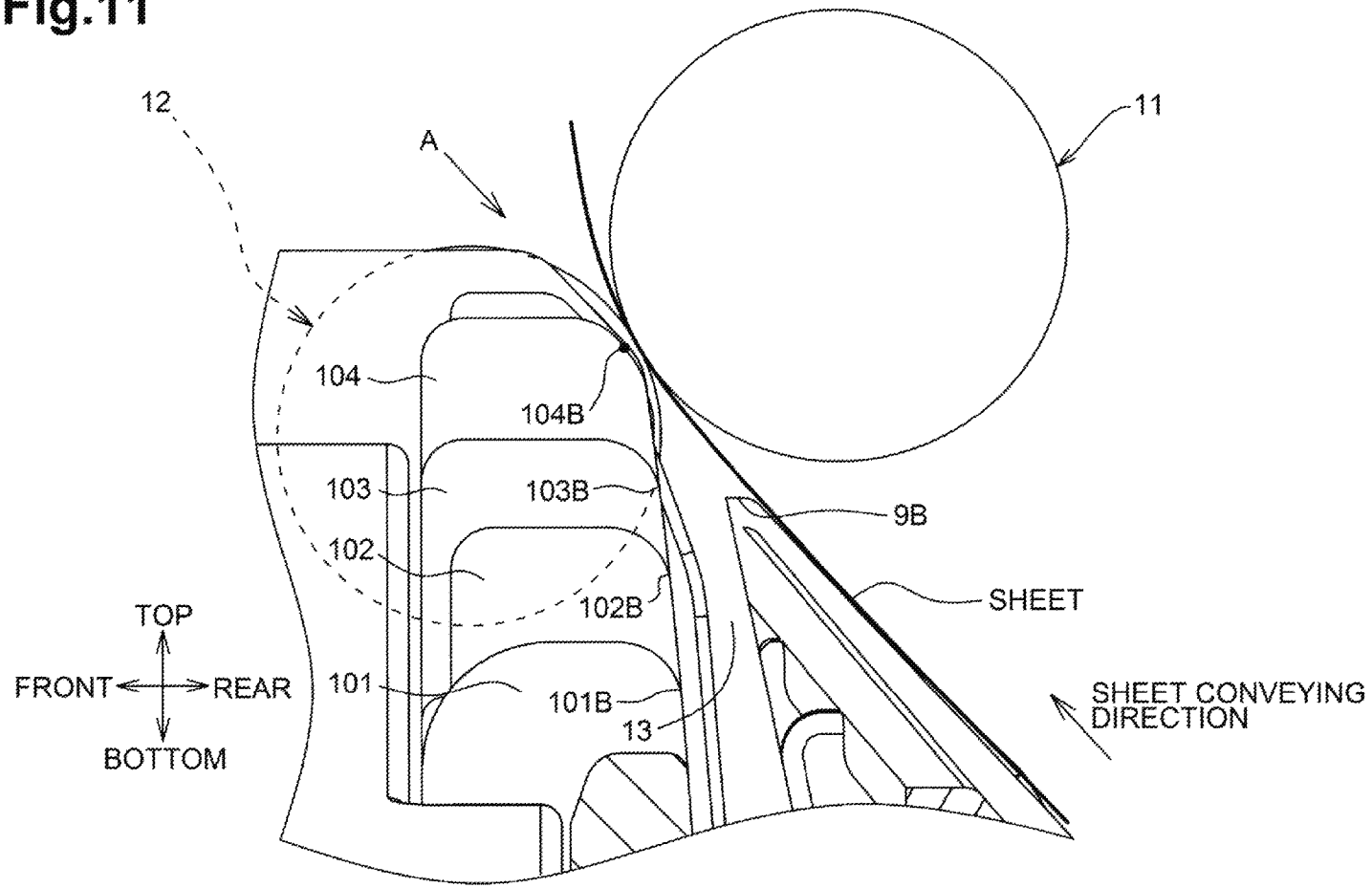
FIG. 11 schematically illustrates that the sheet is nipped by a second roller and the third roller and a downstream side of the sheet contacts a first guide.
Figure 12:
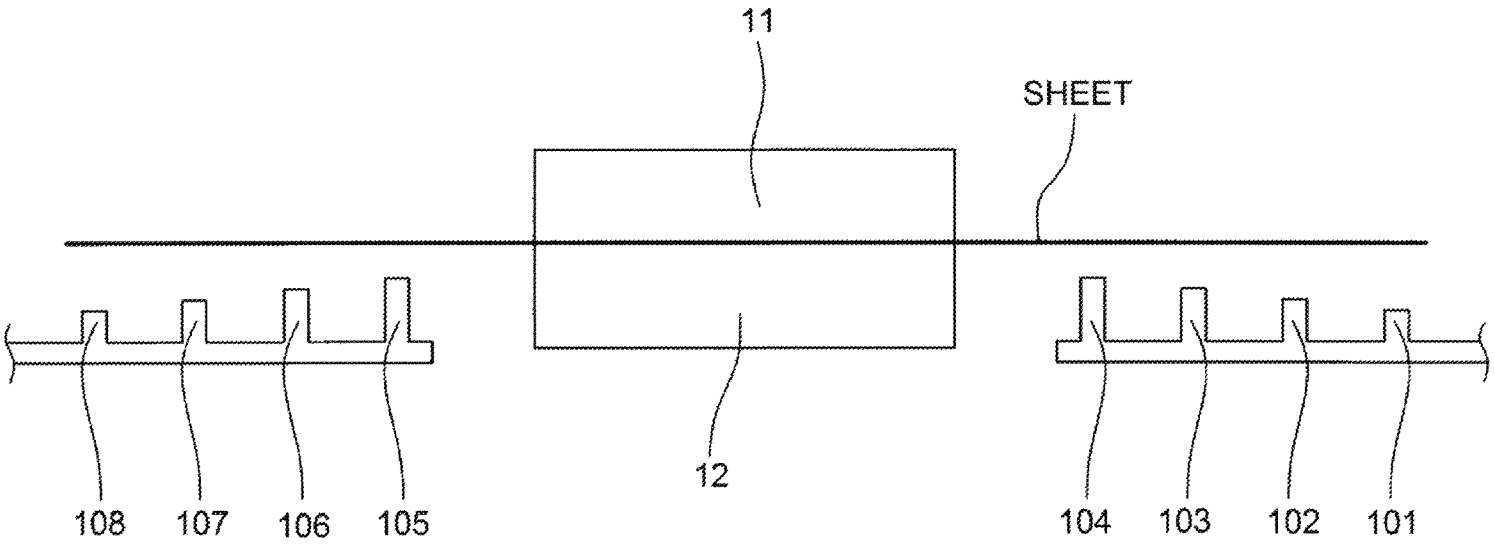
FIG. 12 is a view on arrow A in FIG. 11 illustrating that a sheet is nipped by the second roller and the third roller and a downstream side of the sheet contacts the first guide.

FIGS. 11 and 12 illustrate that a sheet is nipped by the second roller 11 and the third roller 12, and a trailing portion of the sheet in the sheet conveying direction contacts the first guide 9.

As illustrated in FIGS. 11 and 12, after a sheet is nipped by the second roller 11 and the third roller 12, the sheet is conveyed in the sheet conveying direction with being spaced apart from or slightly contacting the second edge portions 101B-104B.

Figure 13:
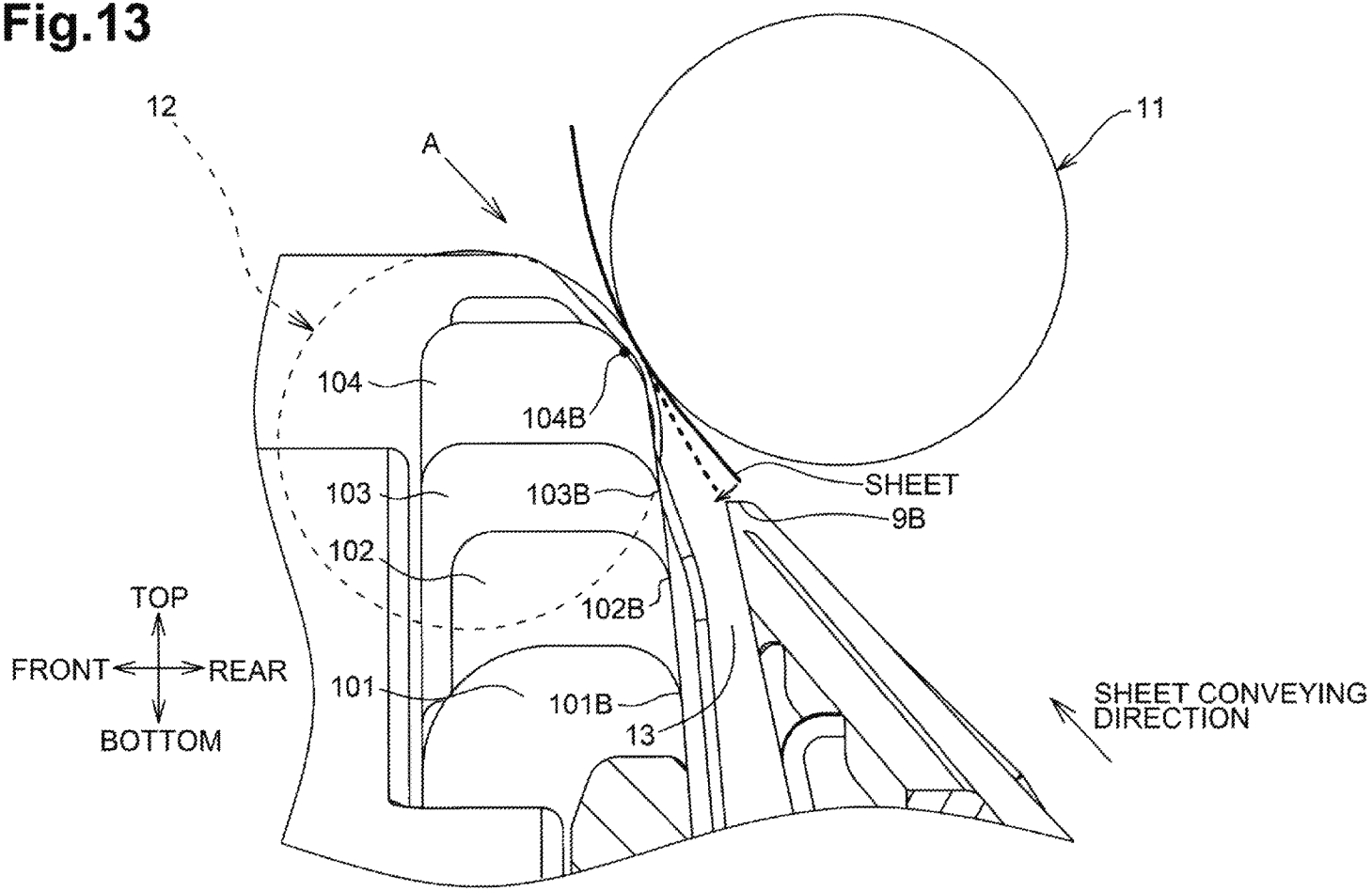
FIG. 13 schematically illustrates that the sheet is nipped by the second roller and the third roller and a trailing end of the sheet is separated from the first edge portion of the first guide.
Figure 14:
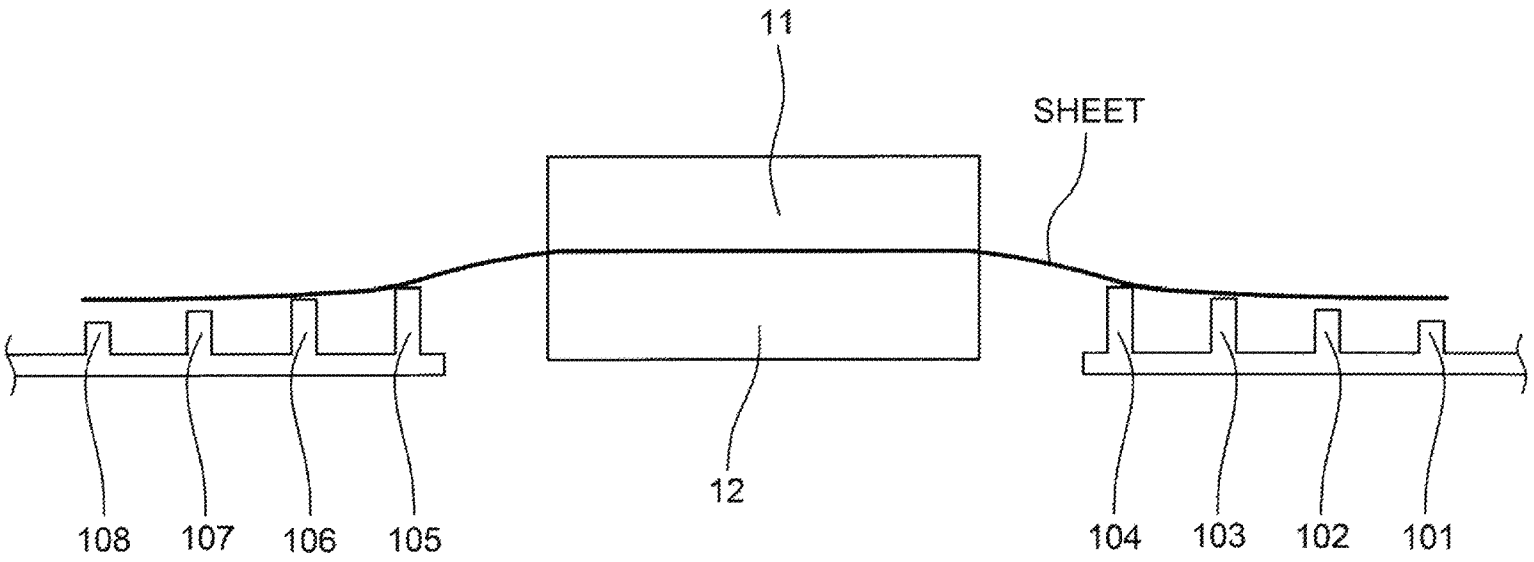
FIG. 14 is a view on arrow A in FIG. 13 illustrating that the sheet is nipped by the second roller and the third roller and the trailing end of the sheet is separated from the first edge portion of the first guide.

FIGS. 13 and 14 illustrate that a sheet is nipped by the second roller 11 and the third roller 12 and a trailing end of the sheet in the sheet conveying direction is just separated from the first edge portion 9B.

When the trailing end of the sheet is just separated from the first edge portion 9B, the trailing end portion of the sheet moves in a direction toward the gap 13, indicated by an arrow in FIG. 13, to quickly return to a flat planer orientation, which is parallel to the second imaginary tangent plane S2 by its flexibility.

At this time, the trailing end of the sheet warps in the width direction (FIG. 14). Simultaneously, the trailing end of the sheet collides with the second edge portion 104B, which is located relatively close to a peripheral surface of the second roller 11 and protrudes relative to the third imaginary tangent plane S3 including the first guide surface 9A (FIG. 5).

In other words, the second edge portion 104B can contact and support the trailing end of the sheet as soon as the trailing end of the sheet is separated from the first edge portion 9B. This positional relationship reduces an amount that the trailing end portion of the sheet moves in the direction toward the gap 13, and thus reduces a chance of generating unwanted noise due to the sheet returning to a flat planer orientation.

In the embodiment, when projected on the cut plane, the second edge portion 104B and the third roller 12 overlap. Thus, the second edge portion 104B is located at a position proximate to a sheet to be conveyed to the nip point between the third roller 12 and the second roller 11, compared with a case where, when projected on the cut plane, the second edge portion 104B and the third roller 12 do not overlap.

This reduces an amount that the trailing end portion of the sheet moves toward the gap 13, leading to less possibility of unwanted noise.

Further, the second edge portion 104B, which is located at the central portion of the second guide surface 10A in the width direction, is located toward the second roller 11 relative to the third imaginary tangent plane S3. Thus, as the second edge portion 104B is located proximate to a sheet to be conveyed to the nip point between the third roller 12 and the second roller 11, the trailing end portion of the sheet can be prevented from greatly moving toward the gap 13, leading to less possibility of unwanted noise occurrence.

The first edge portion 9B according to the embodiment is inclined such that the end portion of the first edge portion 9B in the width direction is located upstream of the central portion of the first edge portion 9B in the sheet conveying direction. Thus, a central portion at the leading end of a sheet reaches the second guide 10 after an end portion at the leading end of the sheet, and the central portion at the leading end of the sheet leaves the first guide 9 after the end portion at the leading end of the sheet.

This structure can reduce noise compared with a structure where the entire leading end of a sheet reaches the second guide 10 and leaves the first guide 9.

Further, the nip point P2 between the second roller 11 and the third roller 12 and each of the end surfaces 101A-108A are offset relative to the sheet thickness direction at the nip point. Thus, when a sheet is nipped by the second roller 11 and the third roller 12 and a trailing end of the sheet in the sheet conveying direction is separated from the first edge portion 9B, the sheet warps such that it is convex in the sheet thickness direction, as illustrated in FIG. 14. This provides greater rigidity in the sheet, and the sheet can be conveyed reliably.

The gap 13 according to the above embodiment serves as a path for conveying a sheet supplied from the sheet supply apparatus 30. However, the gap 13 is not limited to the specific example.

The second guide 10 according to the above embodiment includes the ribs. Instead of the ribs, the second guide 10 may include a surface continuously extending in the width direction as with the first guide 9 or simple protrusions.

The first imaginary tangent plane S1 according to the above embodiment is tangent to the first contact point P1 at which the first roller 8 contacts the separation pad 8A, as illustrated in FIG. 4.

The separation pad 8A may be replaced with a retard roller, for example. In this case, the first imaginary tangent plane S1 may be a plane orthogonal to a line passing through an axis of the first roller 8 and an axis of the retard roller.

What is claimed is:

1. A sheet conveying apparatus configured to convey a sheet, comprising:

a first roller configured to convey a sheet in a sheet conveying direction while rotating in contact with the sheet;

a first guide configured to guide the sheet conveyed by the first roller in the sheet conveying direction, the first guide including a first guide surface and a first edge portion located downstream of the first guide surface in the sheet conveying direction;

a second guide disposed downstream of the first guide in the sheet conveying direction and configured to guide the sheet guided by the first guide in the sheet conveying direction, the second guide including a second guide surface and a second edge portion located upstream of the second guide surface, the second guide being spaced apart from the first guide by a gap defined between the first edge portion of the first guide and the second edge portion of the second guide;

a second roller disposed downstream of the first roller in the sheet conveying direction and above the first roller in a vertical direction, the second roller being configured to convey the sheet in the sheet conveying direction while rotating in contact with the sheet; and a third roller facing the second roller and disposed at a position more proximate to the second guide surface than the second roller, the second roller and the third roller being configured to convey the sheet by nipping the sheet therebetween, wherein a first imaginary tangent plane, which is tangent to a first contact point at which the first roller contacts the sheet, intersects a second imaginary tangent plane, which is tangent to a second contact point at which the second roller contacts the third roller, and the first imaginary tangent plane is located below the second contact point, wherein the first edge portion of the first guide is located toward the second roller relative to the second imaginary tangent plane, wherein, when projected on a cut plane orthogonal to an axis of the third roller, at least a part of the second edge portion overlaps the third roller, and wherein the gap defined between the first edge portion of the first guide and the second edge portion of the second guide forms a sheet conveyance path for conveying a sheet to be supplied from a sheet supply apparatus attached to the sheet conveying apparatus.

2. The sheet conveying apparatus according to claim 1, wherein the second edge portion of the second guide includes a central portion in a width direction orthogonal to the sheet conveying direction and a thickness direction of the sheet, and the central portion of the second edge portion is located toward the second roller relative to a third imaginary tangent plane including the first guide surface.

3. The sheet conveying apparatus according to claim 2, wherein the second edge portion of the second guide includes end portions sandwiching the central portion therebetween in the width direction, and each of the end portions of the second edge portion is located toward the third roller relative to the third imaginary tangent plane.

4. The sheet conveying apparatus according to claim 2, wherein the central portion in the width direction has a dimension in the width direction, which is smaller than a minimum width dimension for sheets to be conveyed in the sheet conveying apparatus.

5. The sheet conveying apparatus according to claim 1, wherein the first edge portion of the first guide includes end portions and a central portion sandwiched between the end portions in a width direction orthogonal to the sheet conveying direction and a thickness direction of the sheet, and wherein the first edge portion of the first guide is inclined such that the end portions are located upstream of the central portion in the sheet conveying direction.

6. The sheet conveying apparatus according to claim 5, wherein the first edge portion of the first guide is inclined such that the central portion is higher than the end portions in the vertical direction.

7. The sheet conveying apparatus according to claim 1, wherein the second guide includes a plurality of ribs being spaced apart from each other in a width direction, the ribs having respective end surfaces, which define the second guide surface and the second edge portion of the second guide.

8. A sheet conveying apparatus configured to convey a sheet, comprising:

a first roller configured to convey a sheet in a sheet conveying direction while rotating in contact with the sheet;

a first guide configured to guide the sheet conveyed by the first roller in the sheet conveying direction, the first guide including a first guide surface and a first edge portion;

a second guide disposed downstream of the first guide in the sheet conveying direction and configured to guide the sheet guided by the first guide in the sheet conveying direction, the second guide including a second guide surface and a second edge portion, the second guide being spaced apart from the first guide by a gap defined between the first edge portion of the first guide and the second edge portion of the second guide;

a second roller disposed downstream of the first roller in the sheet conveying direction and above the first roller in a vertical direction, the second roller being configured to convey the sheet in the sheet conveying direction while rotating in contact with the sheet; and a third roller facing the second roller and disposed at a position more proximate to the second guide surface than the second roller, the second roller and the third roller being configured to convey the sheet by nipping the sheet therebetween, wherein a first imaginary tangent plane, which is tangent to a first contact point at which the first roller contacts the sheet, intersects a second imaginary tangent plane, which is tangent to a second contact point at which the second roller contacts the third roller, and the first imaginary tangent plane is located below the second contact point, wherein the first edge portion of the first guide is located toward the second roller relative to the second imaginary tangent plane, wherein the second edge portion includes a central portion in a width direction orthogonal to the sheet conveying direction and a thickness direction of the sheet, the central portion of the second edge portion is located toward the second roller relative to a third imaginary tangent plane including the first guide surface, and wherein the gap defined between the first edge portion of the first guide and the second edge portion of the second guide forms a sheet conveyance path for conveying a sheet to be supplied from a sheet supply apparatus attached to the sheet conveying apparatus.

9. The sheet conveying apparatus according to claim 8, wherein the second edge portion includes end portions sandwiching the central portion therebetween in the width direction, and each of the end portions of the second edge portion is located toward the third roller relative to the third imaginary tangent plane.

10. The sheet conveying apparatus according to claim 8, wherein the first edge portion of the first guide includes end portions and a central portion sandwiched between the end portions in the width direction orthogonal to the sheet conveying direction and a thickness direction of the sheet, and wherein the first edge portion of the first guide is inclined such that the end portions are located upstream of the central portion in the sheet conveying direction.

11. The sheet conveying apparatus according to claim 10, wherein the first edge portion of the first guide is inclined such that the central portion is higher than the end portions in the vertical direction.

12. The sheet conveying apparatus according to claim 8, wherein the central portion in the width direction has a dimension in the width direction, which is smaller than a minimum width dimension for sheets to be conveyed in the sheet conveying apparatus.

13. The sheet conveying apparatus according to claim 8, wherein the second guide includes a plurality of ribs being spaced apart from each other in the width direction, the ribs having respective end surfaces, which define the second guide surface and the second edge portion of the second guide.

* * * * *